US007654497B1

(12) United States Patent
Karan

(10) Patent No.: US 7,654,497 B1
(45) Date of Patent: Feb. 2, 2010

(54) UNIVERSAL ATTACHING BRACKET

(75) Inventor: Joel Karan, Millburn, NJ (US)

(73) Assignee: POP Displays USA LLC, Yonkers, NY (US)

( * ) Notice: Subject to any disclaimer, the term of this patent is extended or adjusted under 35 U.S.C. 154(b) by 0 days.

(21) Appl. No.: 12/261,863

(22) Filed: Oct. 30, 2008

Related U.S. Application Data

(60) Provisional application No. 60/983,801, filed on Oct. 30, 2007.

(51) Int. Cl.
*A47G 29/02* (2006.01)

(52) U.S. Cl. ..... 248/243; 248/244; 248/250

(58) Field of Classification Search ..... 248/250, 248/235, 241, 243, 244, 245, 246, 220.43; 211/192
See application file for complete search history.

(56) References Cited

U.S. PATENT DOCUMENTS

| | | | | |
|---|---|---|---|---|
| 3,242,886 | A | 3/1966 | Chesley | |
| 4,222,542 | A * | 9/1980 | Wilson et al. | 248/243 |
| 4,575,164 | A | 3/1986 | Pinnow et al. | |
| 5,154,388 | A | 10/1992 | Magaro | |
| 5,165,640 | A * | 11/1992 | Williams, 3rd | 248/220.43 |
| 5,185,971 | A * | 2/1993 | Johnson, Jr. | 52/36.6 |
| 5,356,106 | A | 10/1994 | Trotta et al. | |
| 5,417,396 | A | 5/1995 | Merl | |
| 6,070,841 | A | 6/2000 | Robinson | |
| 6,644,609 | B1 * | 11/2003 | Scott | 248/243 |
| 2004/0108427 | A1 * | 6/2004 | Chen et al. | 248/244 |
| 2004/0227041 | A1 * | 11/2004 | Lewis | 248/220.41 |
| 2007/0221597 | A1 * | 9/2007 | Chen | 211/192 |
| 2008/0156950 | A1 * | 7/2008 | Rutz | 248/250 |

* cited by examiner

*Primary Examiner*—Ramon O Ramirez
(74) *Attorney, Agent, or Firm*—Nolte, Nolte & Hunter; Christopher B. Garvey

(57) ABSTRACT

A system for securing a horizontal display component on different brands of slotted vertical rails, where the different brands of slotted vertical rails have different distances between the vertical rails, and different distances between slots. The system includes a pair of brackets, which slidably adjust their horizontal positions on the horizontal display component. Each of the brackets include a bracket front, secured to a bracket back, at a spacing which slidably encloses a horizontal member of the horizontal display component. A first hook is affixed to the bracket. A vertically slidable lower is slidable on the bracket. The vertically slidable lower has a second hook. The second hook has a slidably variable distance from said first hook, so that the first and second hooks may engage different pairs of said slots at their different distances.

9 Claims, 14 Drawing Sheets

DETAIL A

UNIVERSAL ATTACHING BRACKET

CROSS-REFERENCES TO RELATED APPLICATIONS

This application takes priority from U.S. Provisional Application Ser. No. 60/983,801, filed Oct. 30, 2007.

BACKGROUND OF INVENTION

1. Field of Invention

The present invention relates to the field of retail displays.

2. Related Art

Retailers have different upright fixtures. Some of these are known as Gondolas. Gondolas are the attached free-standing store shelving units.

Isle Gondolas are double sided and wall gondolas are single sided and backed up to a wall.

Such fixtures typically comprise a pair of vertical rails. These are called standards, consistent with the definition as: "A pedestal, stand, or base." Each rail has a plurality of vertically equally spaced slots, into which shelf brackets; shelves; or trays may be mounted. Each shelf manufacturer has its own unique:

vertical slot spacing, and horizontal spacing between the vertical rails.

These unique spacings usually make it impossible to use trays of one manufacturer with uprights of another manufacturer. There is no uniform standard for the dimensions of these standards. For a large retailer with displays acquired at different times from different manufacturers, this non-interchangeability can present a logistical nightmare, when the retailer wants to acquire new shelves or trays for his different stores.

BRIEF DESCRIPTION

The present invention provides a system which includes a type of bracket, which works on all of the different upright fixtures, acting as a universal bracket which can be used to secure fixtures or displays to the fixtures. By using this system, a retailer can ship shelves and trays to all his stores, without determining what type of uprights are already in any particular store.

BRIEF DESCRIPTION OF THE DRAWINGS

Sheet 1

Sheet 2

Figure 3A:
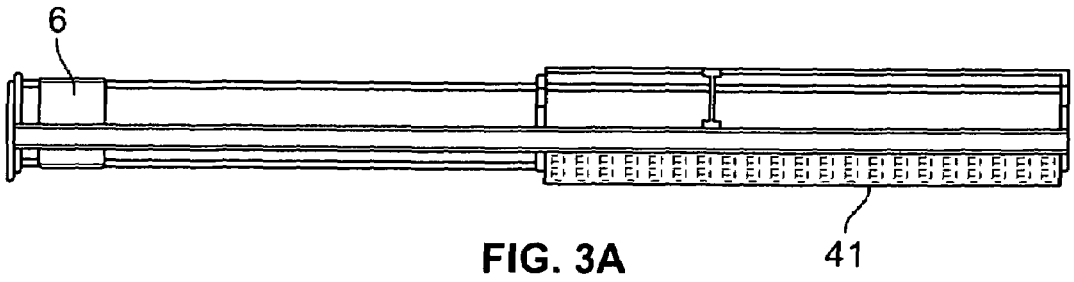

FIG. 3A is a front elevation of the wireform.

Figure 3B:
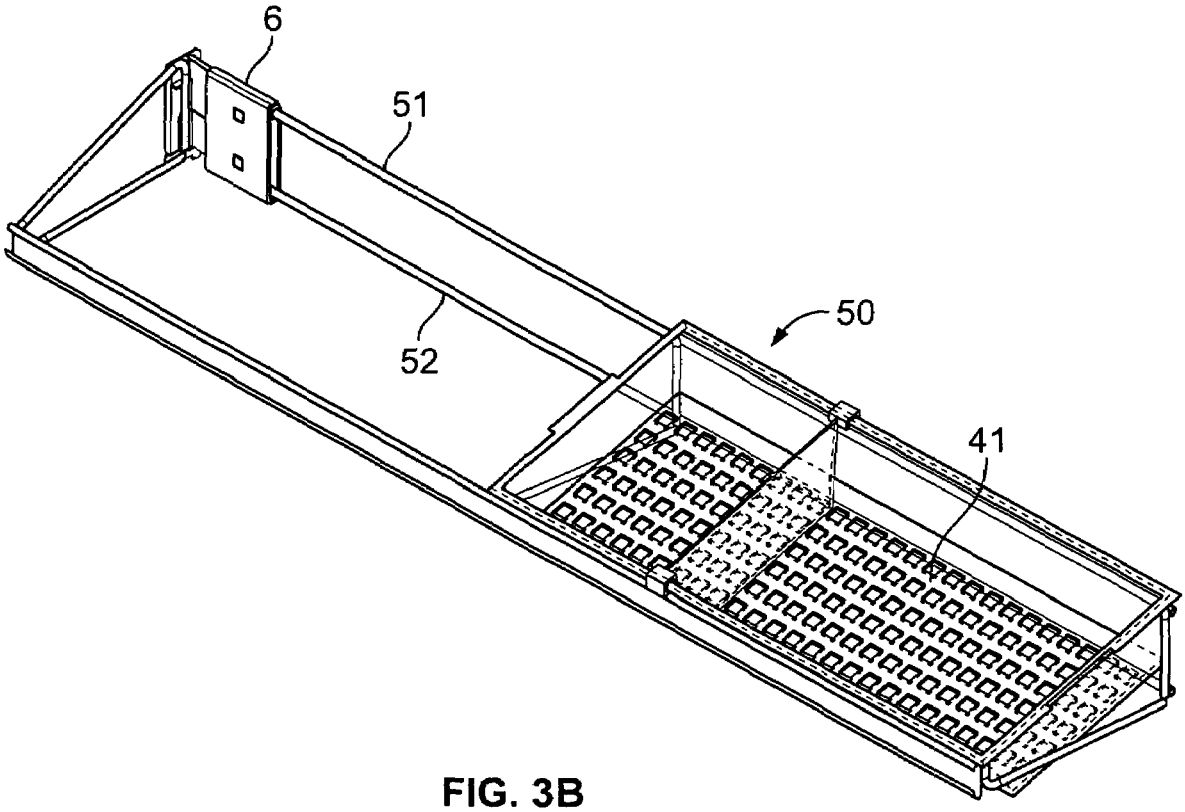

FIG. 3B is an oblique view of the wireform with a tray in place, a divider in the tray, and an adjusting bracket assembly shown slidably attached to the left back.

Figure 3D:
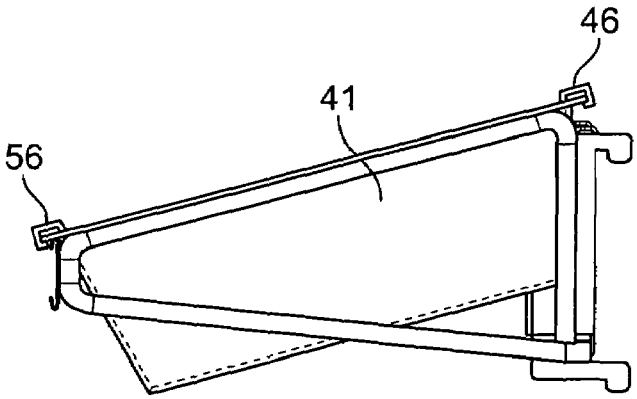

FIG. 3D is a right elevation thereof.

Figure 4:
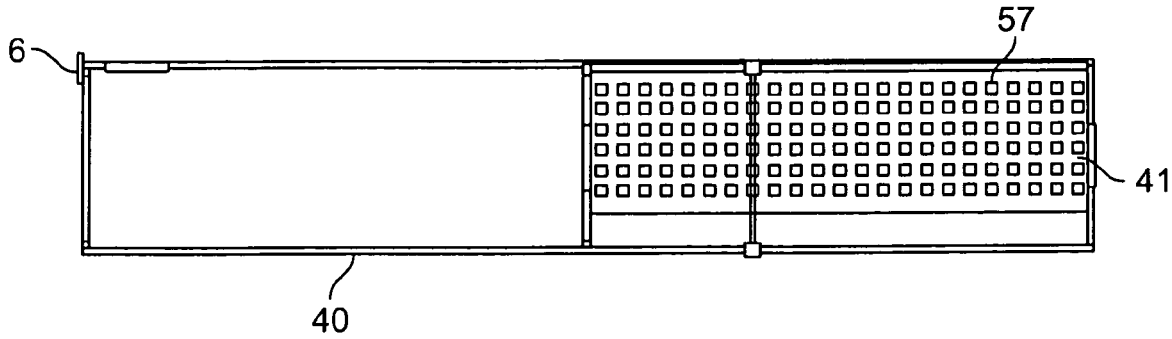

FIG. 4 is a plan view thereof.

Figures 1, 2:
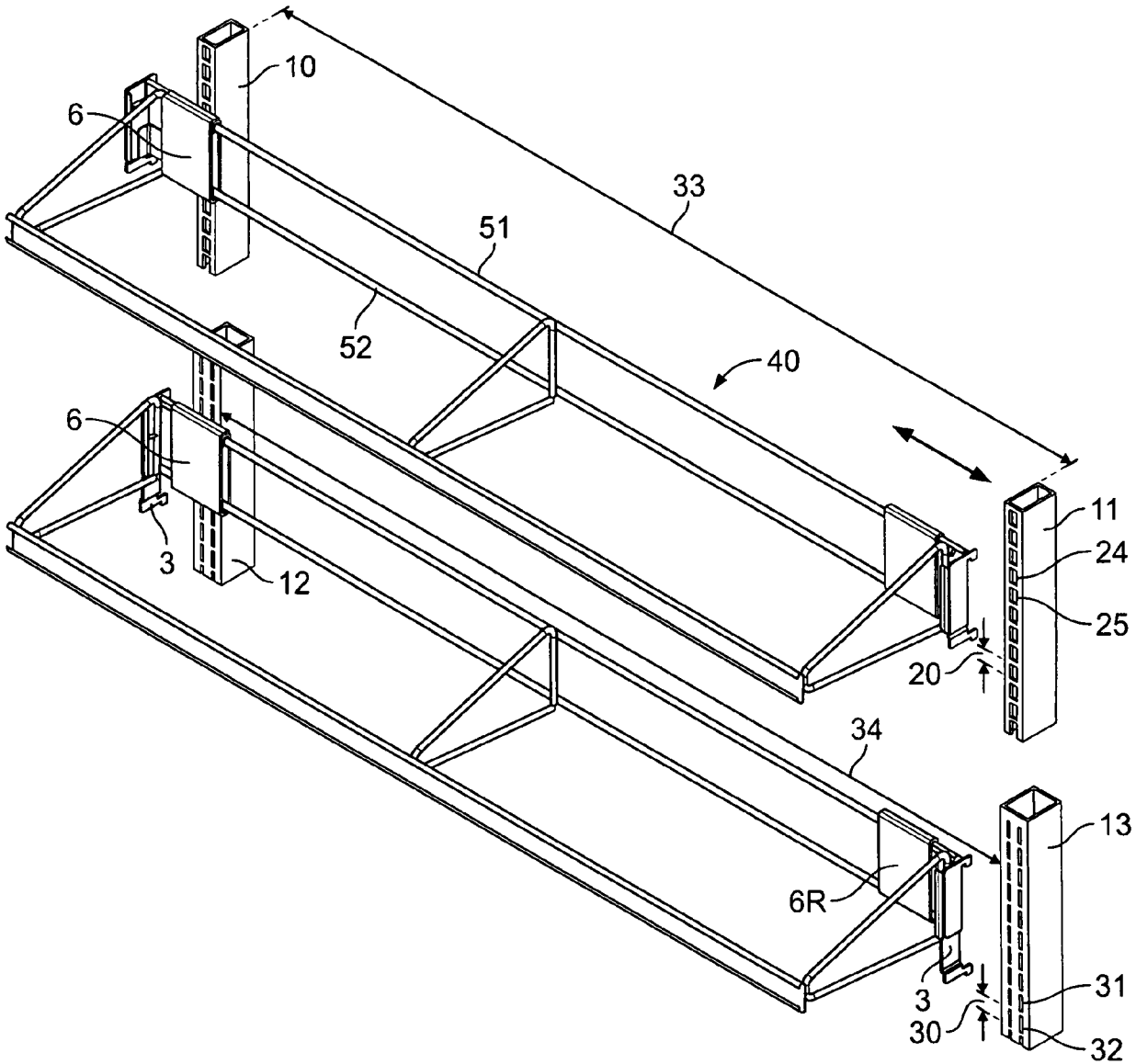
FIG. 1 and FIG. 2 comprise two similar oblique views of the wire frame showing how the brackets adjust horizontally and vertically on the wire frame, to mount on two different sets of vertical rails having different horizontal distances there-between, and different slot patterns.
Figure 5:
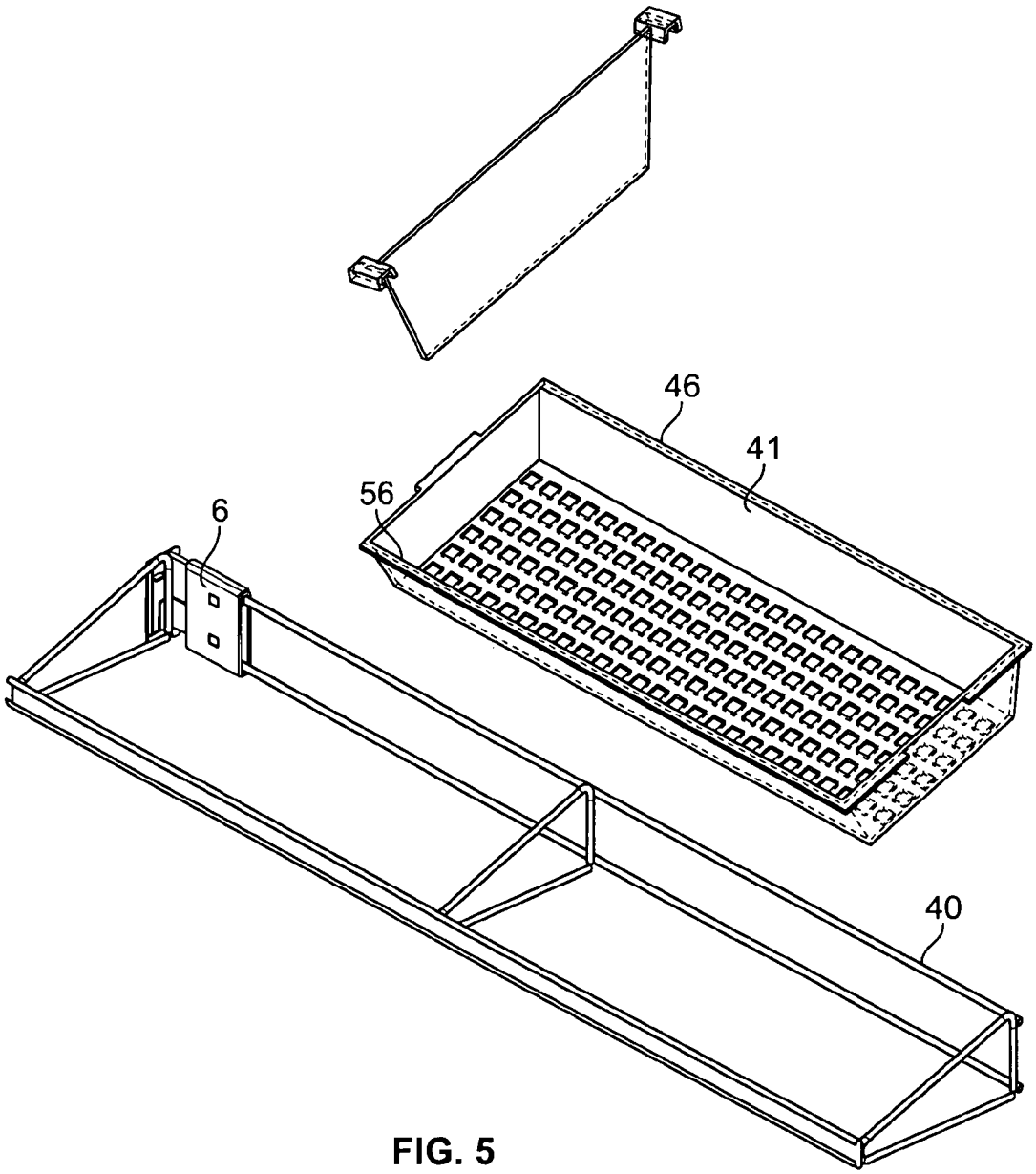

FIG. 5 is an oblique view similar to FIG. 2, but exploded to show each part.

Sheet 3

Figure 6:
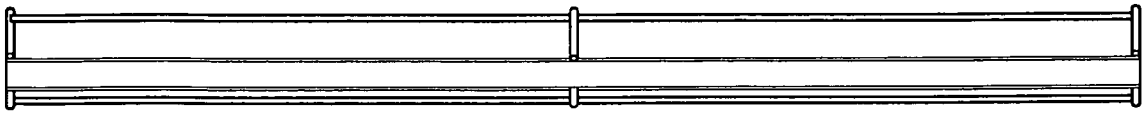

FIG. 6 is a front elevation of the wire frame

Figure 7:
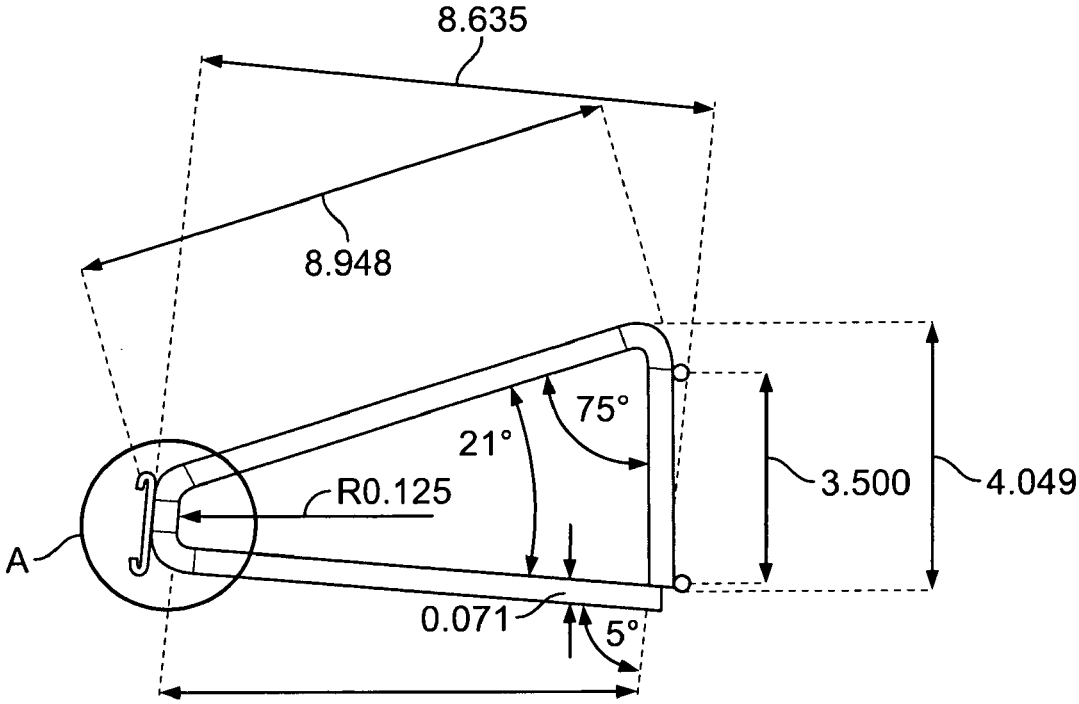

FIG. 7 is a right elevation thereof

Figure 8:
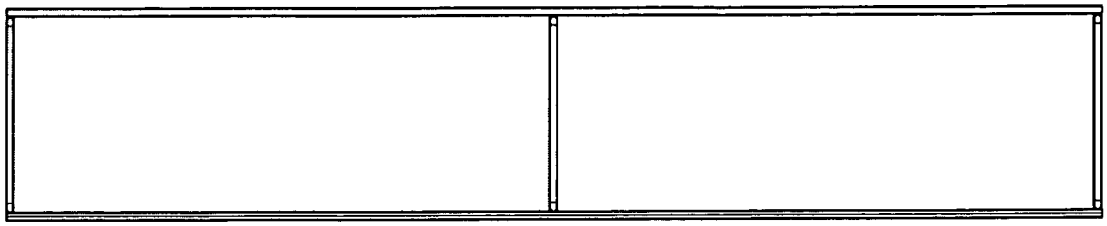

FIG. 8 is a plan thereof

Figure 9:
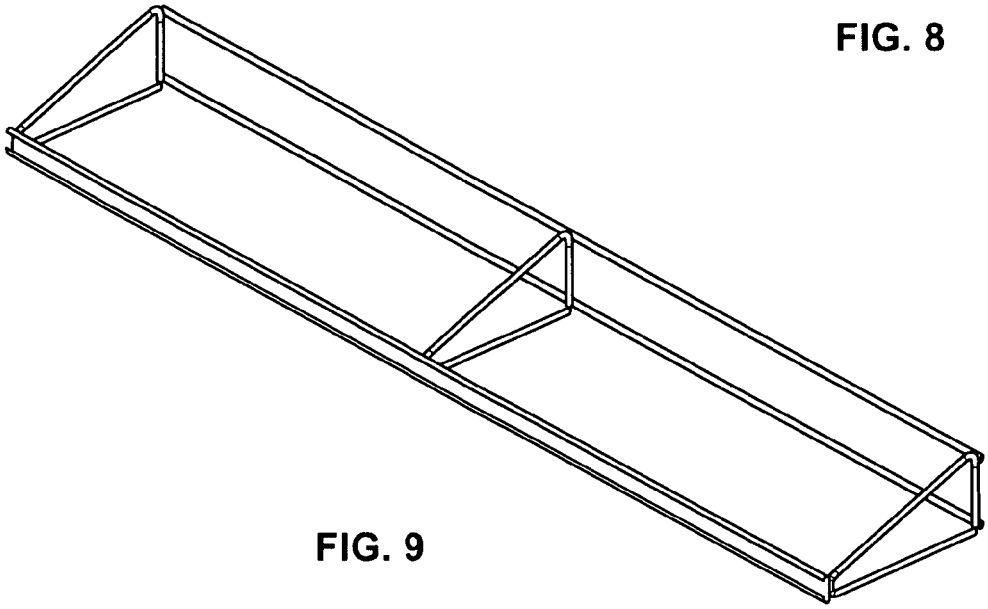

FIG. 9 is an oblique view thereof.

Figure 10:
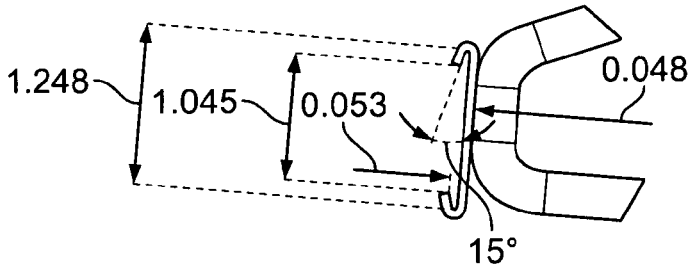

FIG. 10 is a detail from circle A of FIG. 7.

Figure 11:
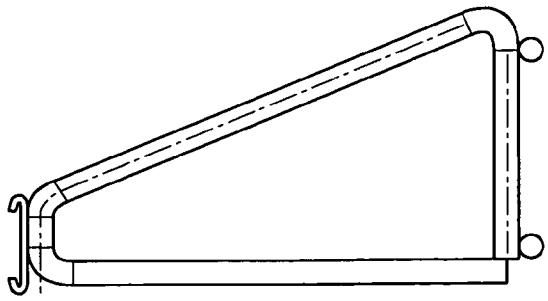

FIG. 11 is similar to FIG. 7, but is not dimensioned.

Sheet 4 details the left bracket assembly, which is a mirror image of the right bracket assembly.

Figure 12:
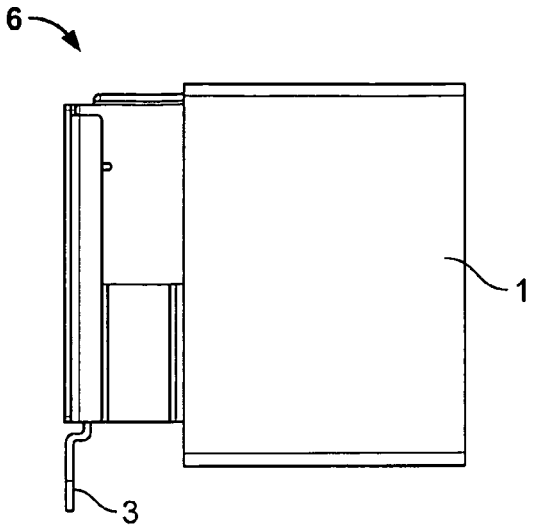

FIG. 12 is a front elevation thereof.

Figure 13:
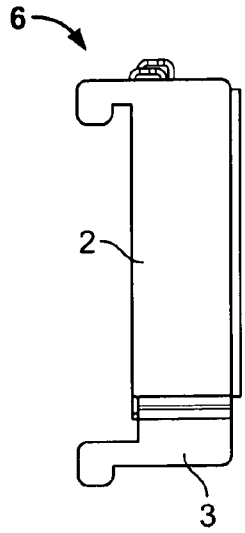

FIG. 13 is a right elevation thereof.

Figure 14:
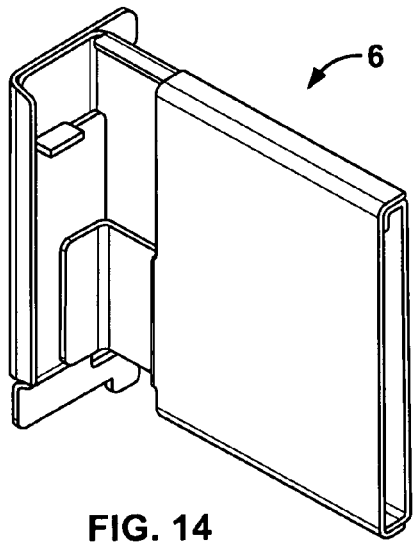

FIG. 14 is an oblique view thereof.

Figure 15:
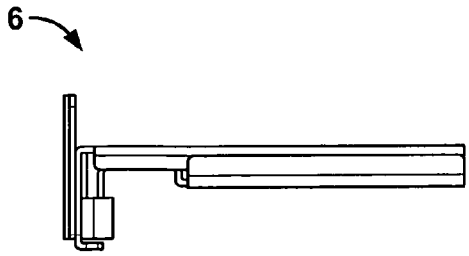

FIG. 15 is a plan view thereof.

Figure 16:
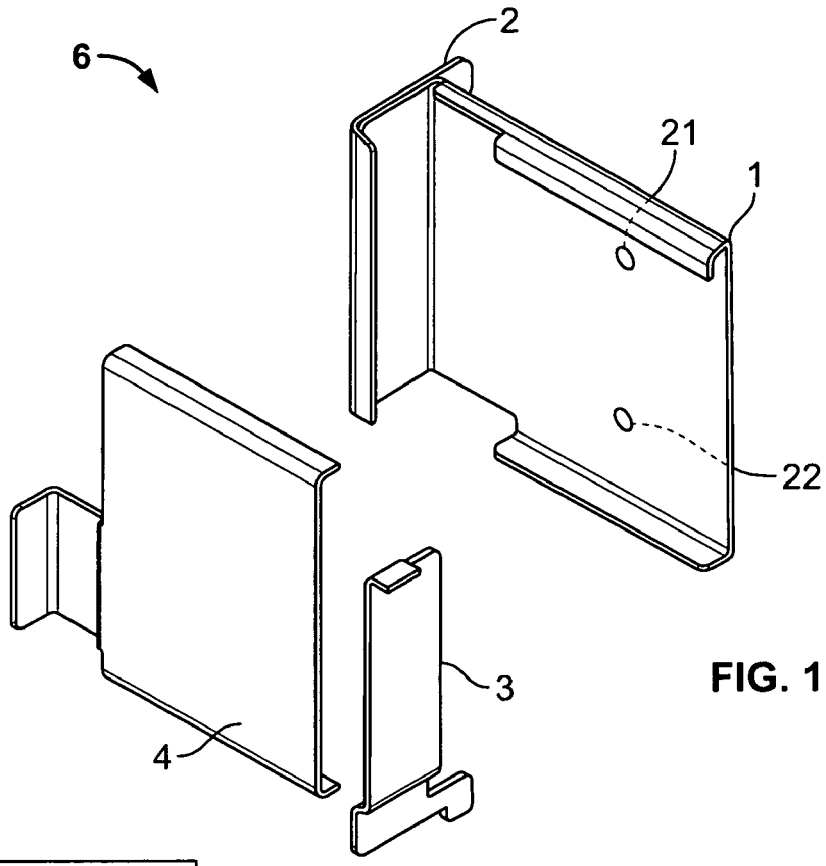

FIG. 16 is an exploded oblique view thereof.

Sheet 5 details each part of the bracket assembly.

Figure 17:
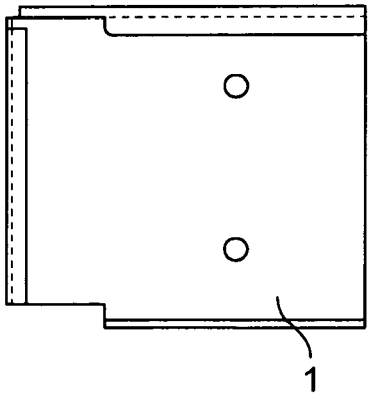

FIG. 17 is a front elevation of the back 1.

Figure 18:
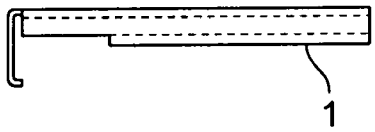

FIG. 18 is a plan of the back.

Figure 19:
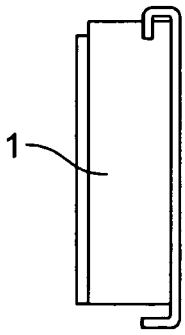

FIG. 19 is a right elevation of the back.

Figure 20:
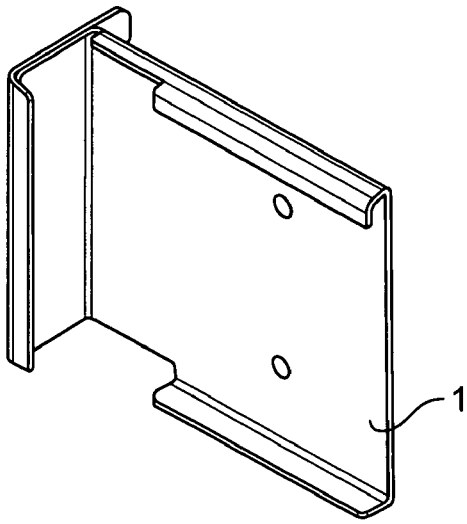

FIG. 20 is an oblique view of the back.

Figure 21:
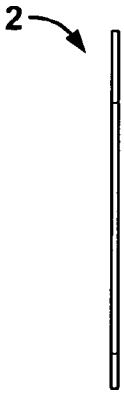

FIG. 21 is a front elevation of bracket piece 2.

Figure 22:
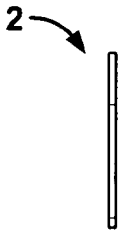

FIG. 22 is a plan of bracket piece 2.

Figure 23:
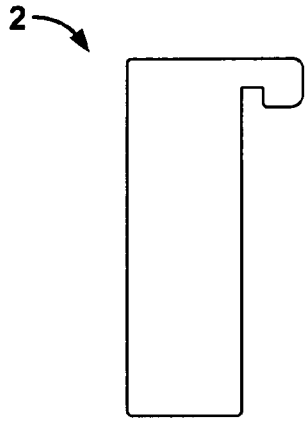

FIG. 23 is a right elevation of bracket piece 2.

Figure 24:
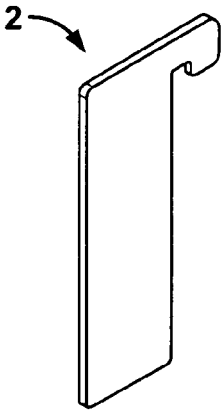

FIG. 24 is an oblique view of the bracket piece 2.

Figure 25:
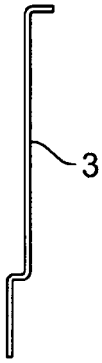

FIG. 25 is a front elevation of bracket piece 3.

Figure 26:
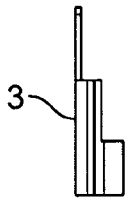

FIG. 26 is a plan of bracket piece 3.

Figure 27:
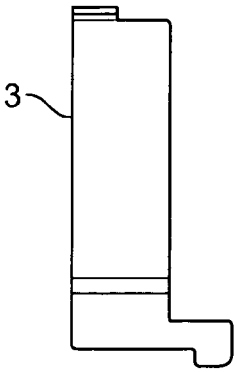

FIG. 27 is a right elevation of bracket piece 3.

Figure 28:
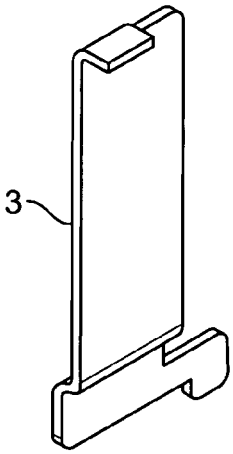

FIG. 28 is an oblique view of bracket piece 3.

Figure 29:
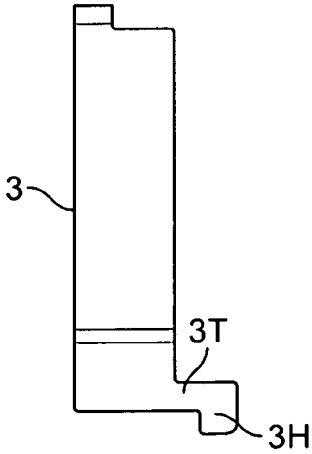

FIG. 29 is similar to FIG. 27, but prior to bracket piece 3 being stamped into shape.

Figure 30:
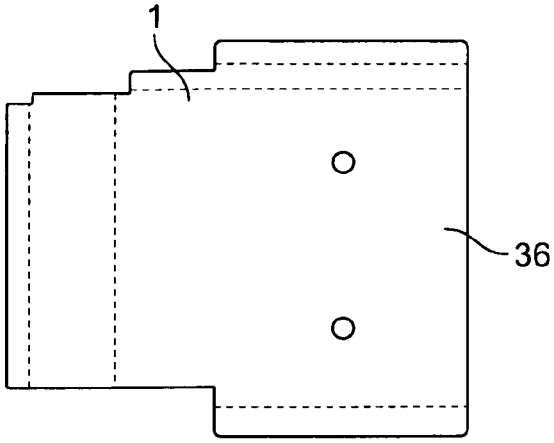

FIG. 30 is a front elevation of back 1 prior to stamping into shape.

Figure 31:
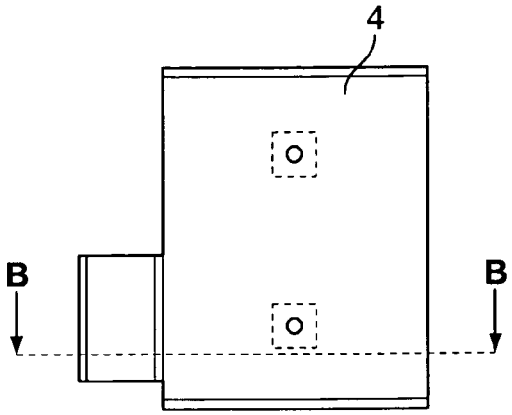

FIG. 31 is a front elevation of bracket front piece 4.

Figure 32:
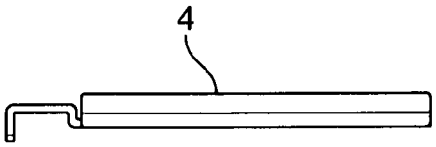

FIG. 32 is a plan of bracket piece 4, and shows section plane BB.

Figure 33:
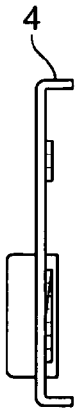

FIG. 33 is a right elevation of bracket piece 4.

Figure 34:
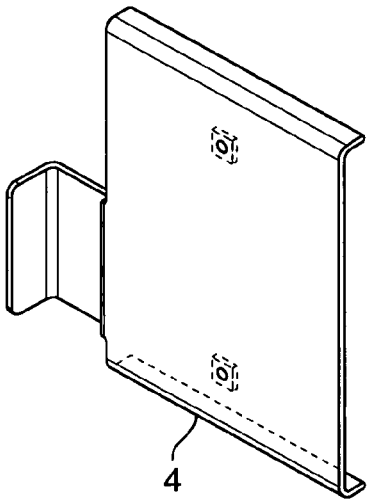

FIG. 34 is an oblique view of bracket piece 4.

Figure 35:
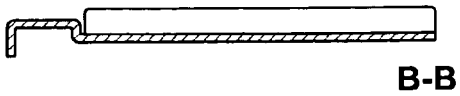

FIG. 35 is a plan sectioned through plane BB of FIG. 31.

Sheet 6

Figure 36:
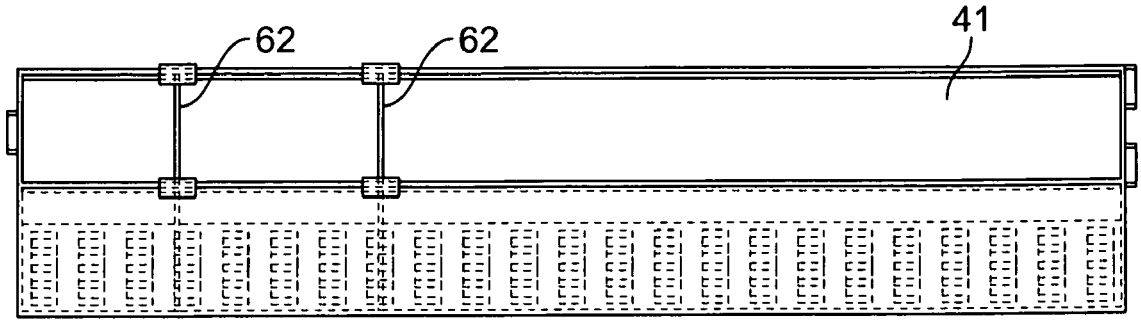

FIG. 36 is a front elevation of a tray.

Figure 37:
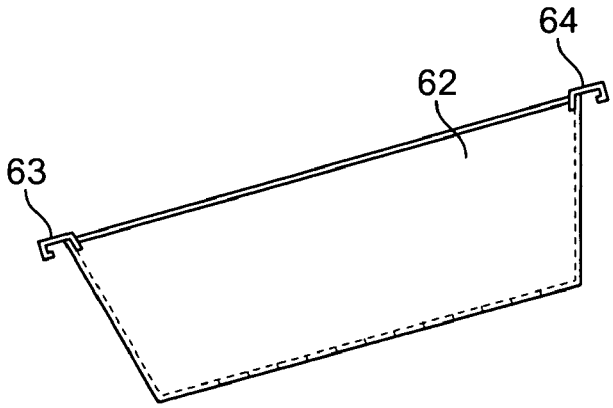

FIG. 37 is a right elevation of the tray.

Figure 38:
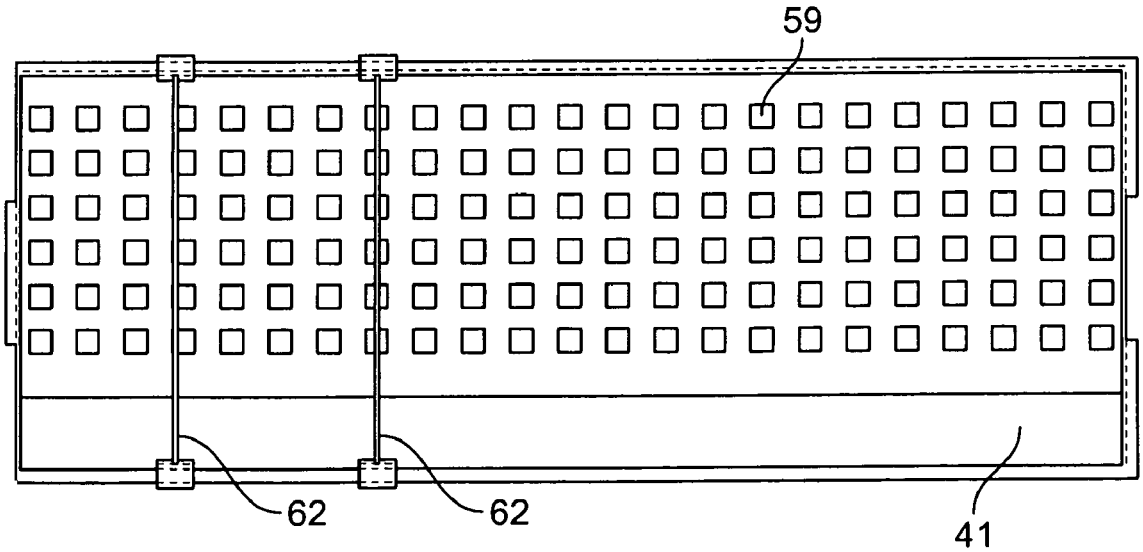

FIG. 38 is a plan of a tray, including dividers.

Figure 39:
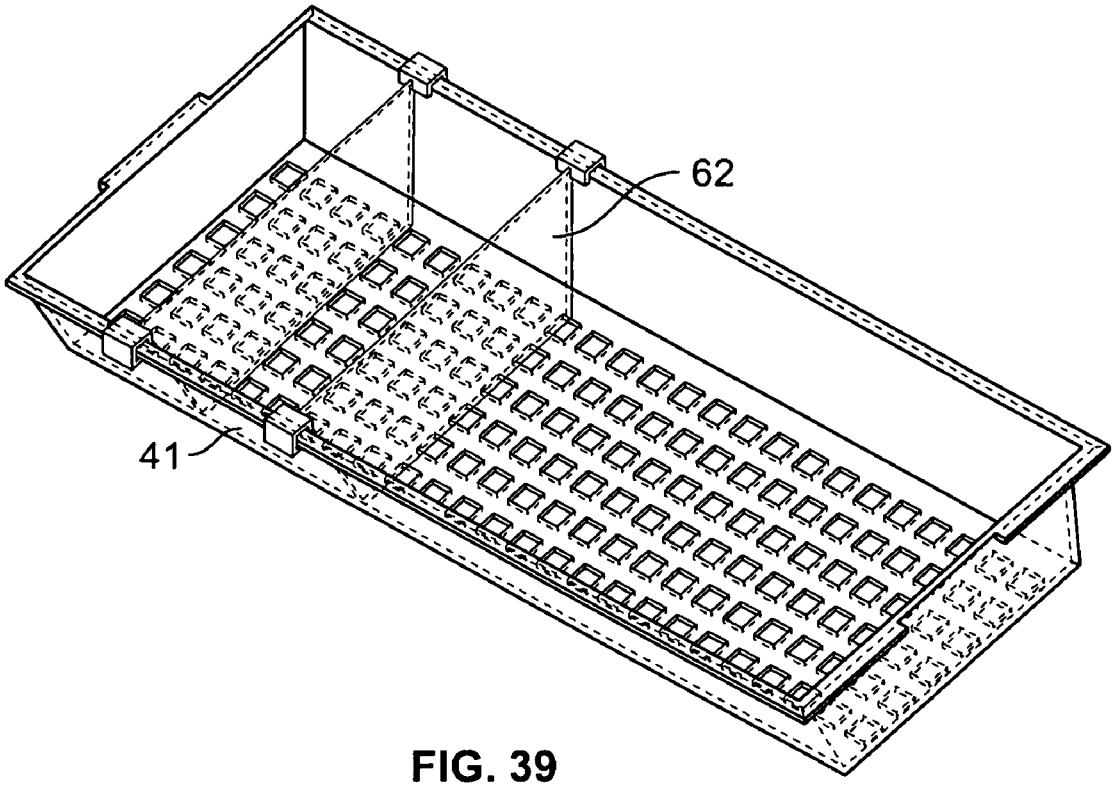

FIG. 39 is an oblique view of the tray, including dividers.

Sheet 7

Figure 40:
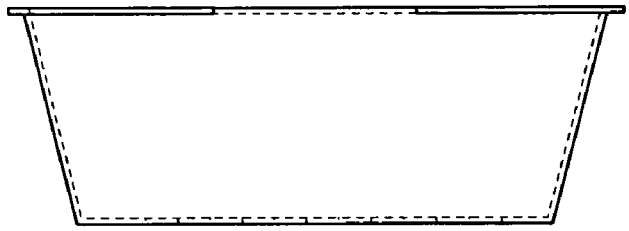

FIG. 40 is a right elevation of a tray

Figure 41:
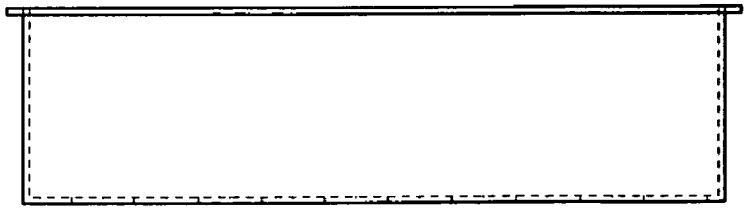

FIG. 41 is a front elevation of a tray

Figure 42:
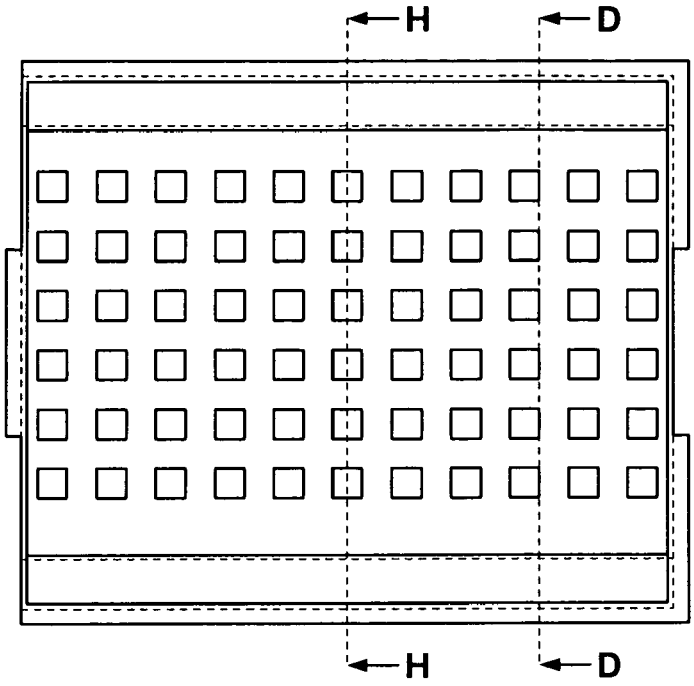

FIG. 42 is a plan of a tray, showing planes DD & HH.

Figure 43:
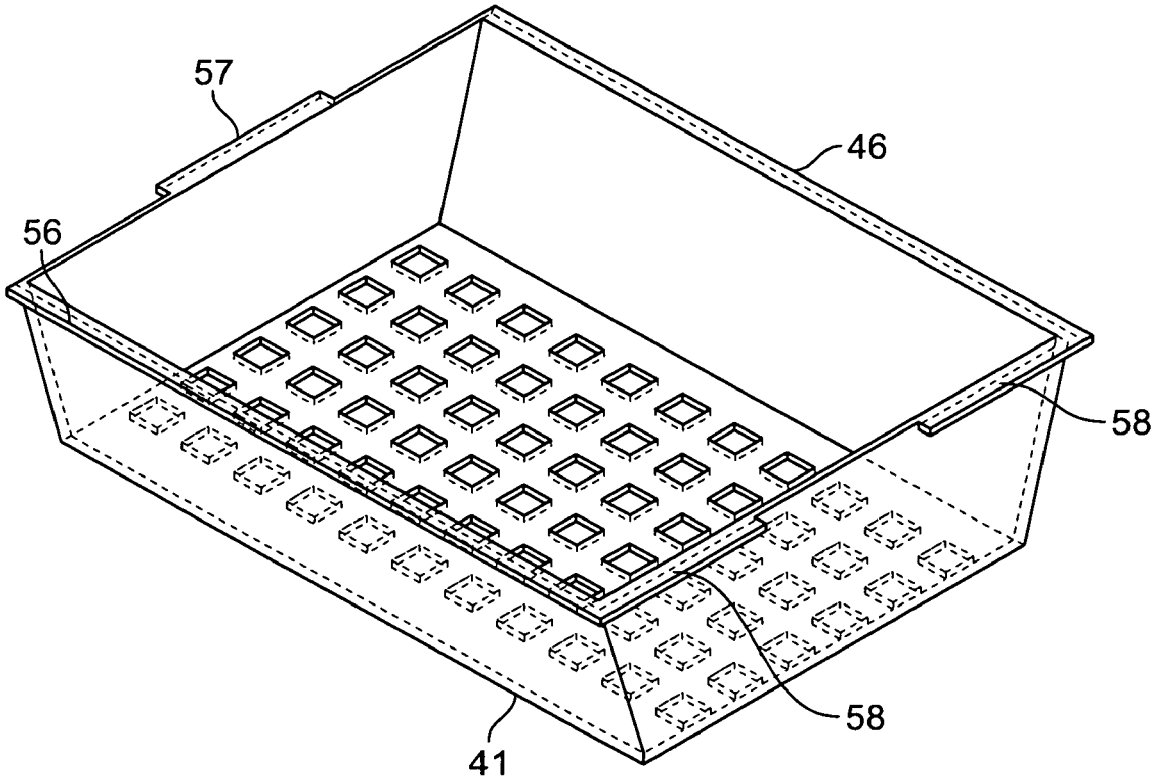

FIG. 43 is an oblique view of the tray.

Figure 44:
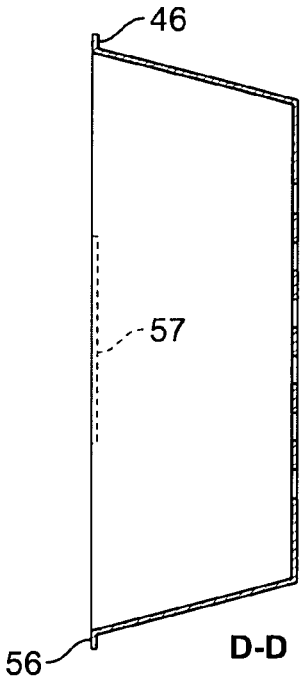

FIG. 44 is Sec. DD and is a right section through plane D of FIG. 42.

Figure 45:
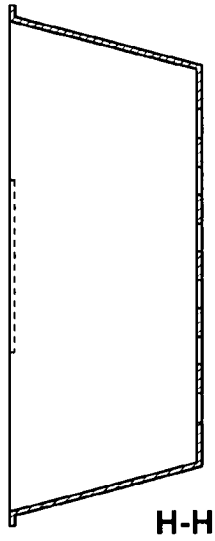

FIG. 45 is Sec. HH and is a right section through plane H of FIG. 42.

Sections DD and HH are right sections through planes D & H of FIG. 42.

Sheet 8

Figure 46:
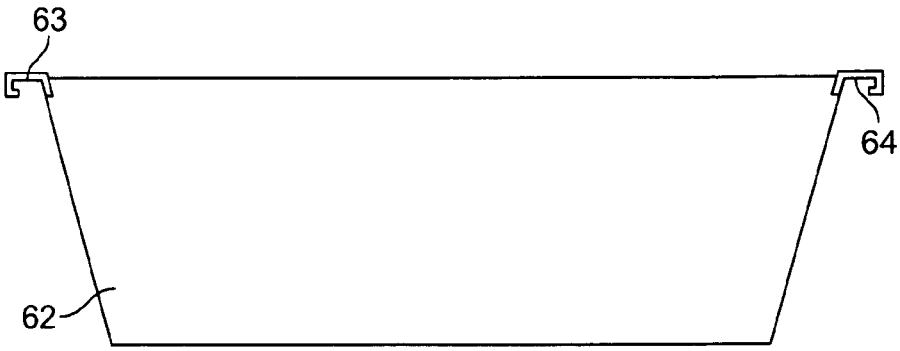

FIG. 46 is a side elevation of a tray divider.

Figure 47:
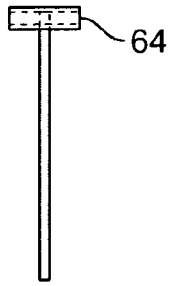

FIG. 47 is a front elevation of tray divider.

Figure 48:
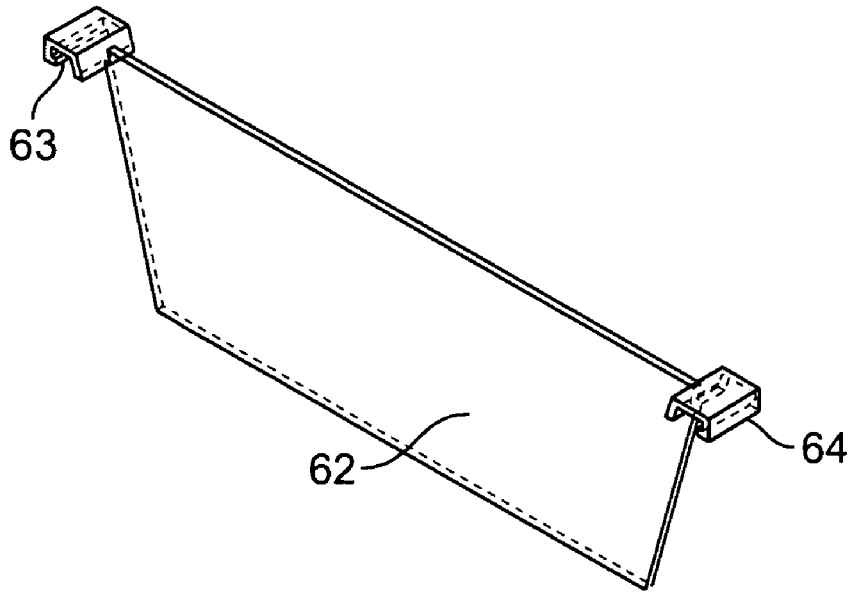

FIG. 48 is an oblique view of tray divider

Figure 49:
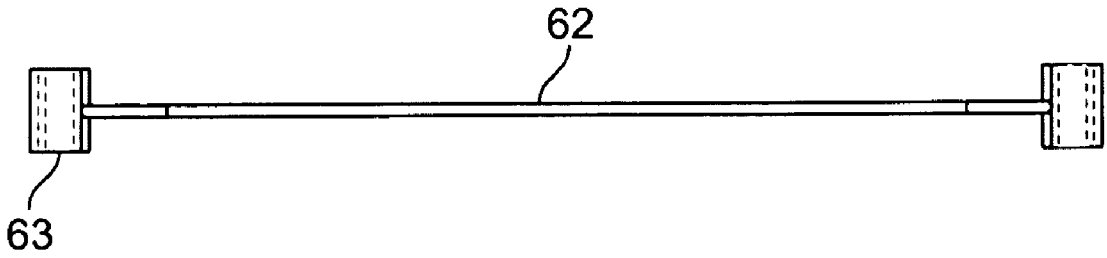

FIG. 49 is a plan of tray divider.

DETAILED DESCRIPTION

FIG. 16 shows four parts 1-4 of bracket assembly 6, shown assembled in FIGS. 12-15, secured together through holes 21-22, screws 23, holes 24-25, and threads 26, shown in FIGS. 17-30.

FIGS. 1 & 2 show a bracket assembly 6, which is adapted for various spacings.

At retail, retailers have different upright fixtures. These upright fixtures typically comprise a pair of slotted rails, such as 10-11 of FIG. 1, and 12 and 13 of FIG. 2. Each shelf manufacturer has its own unique:

vertical slot spacing 20, between slots, such as 24-25 FIG. 1; and 30 between 31-32 FIG. 2 and horizontal spacings 33-34 between the vertical rails 10-11 of FIG. 1 and vertical rails 12-13 of FIG. 2.

These unique spacings make it impossible to use horizontal components, such as trays, shelves, assemblies, or the like, of one manufacturer with uprights of another manufacturer. For a large retailer with displays such as gondola system store fixtures, acquired at different times from different manufacturers, this non-interchangeability can present a logistical nightmare, when the retailer wants to acquire new shelves or trays for his different stores.

This one bracket assembly 6 type, of the present invention, works on all of the different upright fixtures, acting as a universal bracket assembly 6 which can be used to secure shelves, trays, or displays to the fixtures. The presently preferred embodiment is stamped of sheet metal, welded, and powder-coated, but other materials are also contemplated, such as plastics.

This disclosure is of a tray mount, but the disclosed bracket assembly 6 can also be adapted to shelves and to racks of hooks.

The presently preferred prototype comprises a 4 inch high bracket assembly generally designated 6 in FIGS. 12-16 & 17-36.

In the drawings on sheets 4 and 5, the left bracket assembly 6 and right bracket assembly 6R are mirrors of each other.

As in FIG. 16, the bracket assembly 6 comprises four pieces:

1—back 1,

2—left side 2,

3—sliding lower 3, comprising tab 3T and hook 3H, and

4—front 4;

all of which are assembled to form left bracket assembly 6.

Back 1, left side 2, and front 4 are all formed specifically for the left bracket assembly, 6.

As in FIGS. 1&2, Right bracket assembly 6R, is a mirror image of left bracket assembly 6. Right bracket assembly 6R comprises mirror images of these pieces: back 1R, right side 2R, and front 4R along with sliding lower tab and hook 3, which is reversible and can be used interchangeably on the left side of right bracket assembly 6R.

Back 1, front 4 are clamped together by some conventional form of securement, to fit slidably over the back rails of the wire form. Securement may be in various forms, such as bayonet clips, snaps, welds, rivets, ratchets, etc. The bracket 6 may be formed of metals; or of non-metals such as plastics, which might be secured together by rivet, snap together, sonic weld, heat stake, etc.

But in the presently preferred prototype embodiment, the securement comprises: back 1, which comprises two embossed and countersunk holes 21-22, each sized to loosely fit a 10/32 countersunk machine screw 23. Front 4 comprises a second pair of holes 24-25, coaxial to holes 21-22, and comprising threads to receive the threaded shafts of said machine screws, or holes 21-22 may be sized to receive sheet metal screws, or self-tapping screws.

The back 1, and left side 2, are welded together into back assembly 28. In the presently preferred embodiment, they are next powder coated with a durable protective finish 36. We presently prefer tapped machine screws 23, so that this finish 36 is not much damaged by screwing. But assembly may be less expensive with the other aforementioned options.

Left bracket Front 4 is attached to back assembly 28, by two of the machine screws 23, enclosing sliding lower tab and hook 3, loosely, so it is vertically slidable for any of the various vertical slot spacings of the various manufacturers.

Contemplated, but not yet shown, is securement of the vertically sliding lower tab 3 (FIG. 16) to prohibit removal of a bracket 6 from the vertical standards or slotted rails 10-13, unless unsecured.

Hook 3H could be clamped within a slot by frictional forces, by a biasing device, such as a thumbscrew, snap tab, wedge, lever, gravity activated pivotal cam, or the like. Thus hook 3H, and the display element it supports, could not be accidentally dislodged from its slot by a mere jostle.

FIGS. 1 & 2 show wire frame 40. Left bracket assembly 6 front 4 is spaced to back assembly 28, with slidable clearance around at least one horizontal member of the wire frame, such as horizontal members: rail 51, and rail 52. Thus, bracket assembly front 4 and back 1 slidably and partially enclose wire frame 40's rails 51 & 52, by being slidably clamped about wire rails 51-52, as shown in FIGS. 1, 2, 3A, 3B, 3D, 4, & 5; so that bracket assemblies 6 and 6R are horizontally slidable for any of the various horizontal spacings of the vertical rails of various manufacturers as in FIG. 1 & FIG. 2.

Wire frame 40 is detailed in FIGS. 3-11.

As in FIGS. 3-5 & 36-45, metal or plastic sample trays such as tray 41 are provided, which rest snugly in wire frame 40.

As in FIGS. 40-45, tray 41 may have smooth rail like lips 46, 56, 57 & 58, or may have rampart-like protrusions and indents, not shown, on their back top rim 46.

Tray 41 may have rampart-like protrusions and indents not shown on their front top rim 56. As in FIGS. 36-39, these protrusions and indents may cooperate with slots on floors of the tray 41 to locate the dividers 62. But in the presently preferred embodiment of FIGS. 37 to 48, shaped channels 63-64 grab rails 46 & 56 of FIGS. 36-39 to slidably hold divider 62 vertically in position within tray 41.

Trays 41 may have closed floors, but the present embodiment shows a grid of square holes 59, which in the embodiment shown: ventilate the product, prevent the accumulation of liquids, and allow small debris to fall through. As in FIGS. 42-43, tray 41 has square openings 59 on its floors. These openings 59 may cooperate with tabs, not shown, on divider 62.

The assembled structure of FIGS. 3-4 can then be hung, as in FIGS. 1&2, on the vertical rails 10-13 of a retail display fixture.

Sheet 1, FIG. 1 and FIG. 2 comprise two similar oblique views of the wire frame. The brackets adjust horizontally on the wire frame, to mount on two or more different sets of vertical rails, such as rails 10-11 and 12-13, having different horizontal distances 33 & 34 there-between.

Bracket part 3 and its tab 3T adjust vertically, so that each bracket 6 can be adjusted to fit into different slot patterns, having different vertical distances 20 & 30 between the slots. Thus, the brackets 6 & 6R can be installed on the vertical rails 10-13 of any of today's known manufacturers.

Other embodiments are also contemplated which fall within the scope of this disclosure.

I claim:

1. A system for securing a horizontal display component, to mount on a plurality of different sets of pairs of slotted vertical rails, said slotted vertical rails having different distances between the pairs of slotted vertical rails, and different distances between slots, said system including:

a pair of brackets, each of said brackets including:
a bracket front, secured to
a bracket back, at a spacing which slidably attaches a horizontal member of said horizontal display component;
a first hook affixed to said bracket;
a lower, vertically slidable on said bracket;
said vertically slidable lower having a second hook, which second hook has a slidably variable distance from said first hook.

2. A system according to claim 1 in which the pair of brackets include:
a left bracket; and
a right bracket;
the right bracket has:
its front and back as mirror images of
the front and back of the left bracket;
and the vertically slidable lower of the left bracket is interchangeable with the a vertically slidable lower of the right bracket.

3. A system according to claim 2 in which the bracket front is secured to the bracket back, by:
a back hole in the bracket back,
a front hole in the bracket front, coaxial to the back hole,
a screw, screwed through the front and back holes, by which bracket front is secured to the bracket back.

4. A system according to claim 3 in which the horizontal display component is a wire form, said wire form having a horizontal member to which the brackets are slidably attached.

5. A system according to claim 4 in which a tray is mounted to the wire form.

6. A system according to claim 1 in which the bracket front is secured to the bracket back, by:
a back hole in the bracket back,
a front hole in the bracket front, coaxial to the back hole,
a screw, screwed through the front and back holes, by which bracket front is secured to the bracket back.

7. A system according to claim 1 in which the horizontal display component is a wire form, said wire form having a horizontal member to which the brackets are slidably attached.

8. A system according to claim 7 in which a tray is mounted to the wire form.

9. A system for securing a horizontal display component, to mount on a plurality of different sets of pairs of slotted vertical rails, said slotted vertical rails having different distances between the pairs of slotted vertical rails, and different distances between slots, said system including:
a pair of brackets, which slidably adjust their horizontal positions on said horizontal display component,
each of said brackets including:
a bracket front, secured to
a bracket back, at a spacing which slidably encloses a horizontal member of said horizontal display component;
a first hook affixed to said bracket;
a vertically slidable lower, slidably enclosed by said bracket front, and said bracket back,
said vertically slidable lower having a second hook, which second hook has a slidably variable distance from said first hook, so that the first and second hooks may engage different pairs of said slots at their different distances;
the pair of brackets include:
a left bracket; and
a right bracket;
the right bracket has:
its front and back as mirror images of
the front and back of the left bracket;
the vertically slidable lower of the left bracket is interchangeable with the a vertically slidable lower of the right bracket;
the bracket front is secured to the bracket back, by:
a back hole in the bracket back,
a front hole in the bracket front, coaxial to the back hole,
a screw, screwed through the front and back holes, by which bracket front is secured to the bracket back,
the horizontal display component is a wire form, said wire form having a horizontal member to which the brackets are slidably attached; and
a tray is mounted to the wire form.

* * * * *